US005788125A

United States Patent [19]

Steiner et al.

[11] Patent Number: 5,788,125

[45] Date of Patent: Aug. 4, 1998

[54] SIP AND SPRAY FLUID CONTAINER ASSEMBLY

[76] Inventors: Edward H. Steiner, 24 Pershing Ave., Lebanon, Pa. 17042; Eric P. Umberger, 191 Pine View Dr., Palmyra, Pa. 17028

[21] Appl. No.: 661,035

[22] Filed: Jun. 10, 1996

[51] Int. Cl.[6] ..... B05B 9/00

[52] U.S. Cl. ..... 222/331; 222/385; 222/482; 222/525

[58] Field of Search ..... 222/331, 383.1, 222/385, 481, 482, 524, 525

[56] References Cited

U.S. PATENT DOCUMENTS

| | | | |
|---|---|---|---|
| 2,080,602 | 5/1937 | Chamberlain | 222/481 |
| 2,512,105 | 6/1950 | Kooij et al. | 222/481 |
| 2,888,176 | 5/1959 | Miller | 222/482 |
| 3,142,443 | 7/1964 | Morgan | 222/482 |
| 3,288,375 | 11/1966 | Conover | 222/383.1 |
| 3,648,933 | 3/1972 | Grotz | 222/481 |
| 4,030,664 | 6/1977 | Tisbo et al. | 222/481 |
| 4,614,284 | 9/1986 | Miles | 222/331 |
| 4,618,076 | 10/1986 | Silvenis | 222/331 |
| 4,702,473 | 10/1987 | Paquette | 222/525 |
| 4,705,191 | 11/1987 | Itzel et al. | 222/383.1 |
| 4,932,563 | 6/1990 | Diamond et al. | 222/383.1 |
| 5,154,317 | 10/1992 | Roppolo, III | 222/331 |
| 5,335,853 | 8/1994 | Wirz | 222/385 |
| 5,373,973 | 12/1994 | Foster | 222/385 |
| 5,439,141 | 8/1995 | Clark et al. | 222/383.1 |
| 5,542,581 | 8/1996 | Habora et al. | 222/331 |

*Primary Examiner*—J. Casimer Jacyna

[57] ABSTRACT

A new Sip and Spray Fluid Container Assembly for a fluid container suitable for spray mist cooling and for serving drinking water.

The inventive device includes a fluid container having a handle, a mist spray nozzle with a pump and a pump trigger, a drinking spout, and a fill spout. In use, the Sip and Spray Fluid Container Assembly is filled with drinking water or any fluid of desire and can be taken any where by the user. In the hot sun light, when children's hard play causes them to feel uncomfortable due to the feeling of over heat, the Sip and Spray Fluid Container Assembly can be used to spray a mist of water on oneself, also a drink can be conveniently taken. The Sip and Spray Fluid Container Assembly can be completely closed off to keep the drinking water clean.

10 Claims, 3 Drawing Sheets

FIG. 1
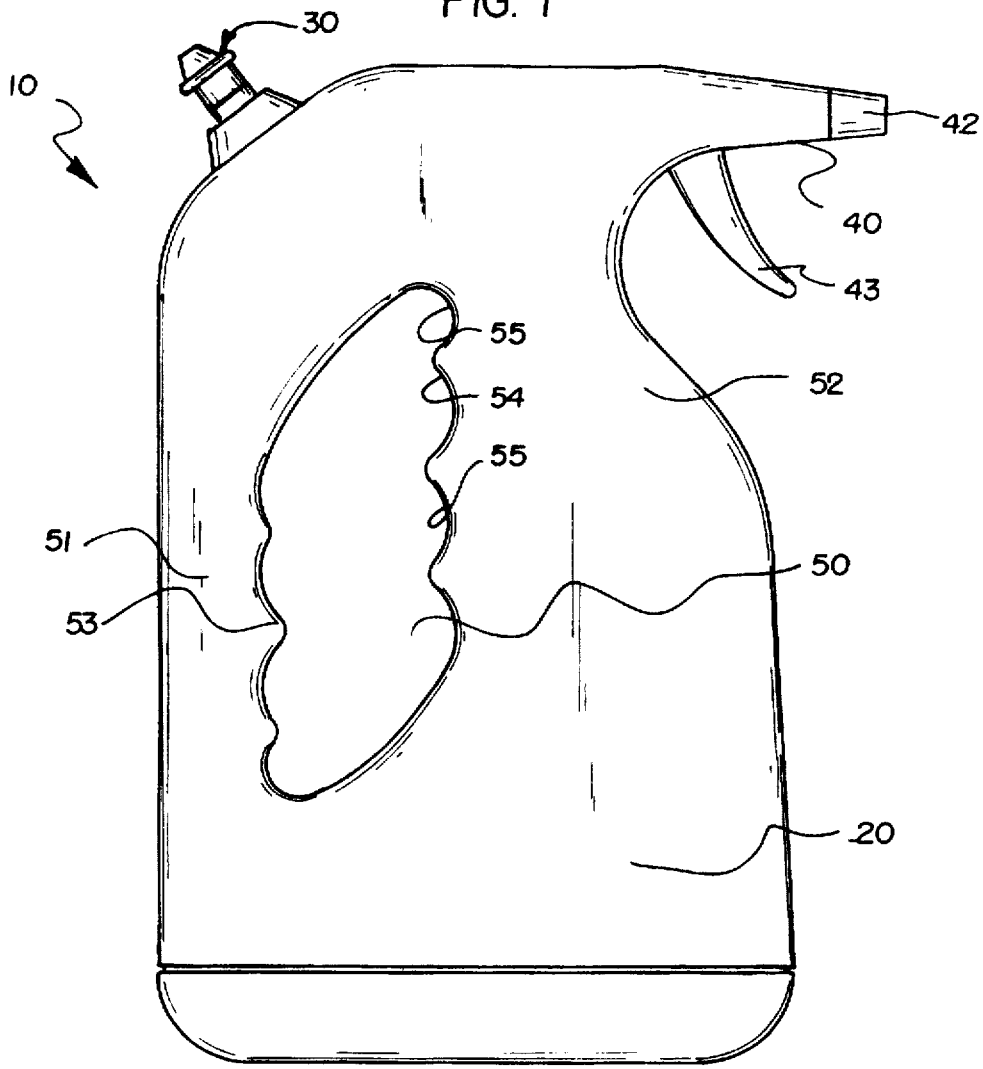
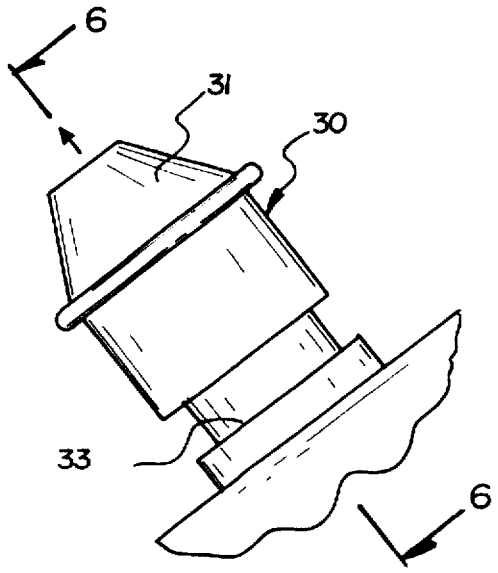
FIG. 2

SIP AND SPRAY FLUID CONTAINER ASSEMBLY

BACKGROUND OF THE INVENTION

1. Field of the Invention

The present invention relates to Spray Bottles and more particularly pertains to a fluid container for serving drinking water and for spraying cooling mist on the user.

2. Description of the Prior Art

The use of Spray Bottles is known in the prior art. More specifically, Spray Bottles heretofore devised and utilized are known to consist basically of a familiar, expected and obvious structural configurations, notwithstanding the myriad of designs encompassed by the crowded prior art which have been developed for the fulfillment of countless objectives and requirements.

Known prior art Spray Bottles include U.S. Pat. No. 5,044,512 issued to Giancaspro et al. on 3 Sep. 1991; U.S. Pat. No. 5,318,205 issued to Delaney, Jr. on 7 Jun. 1994; U.S. Pat. Des. 247,302 issued to Federico et al. on 21 Feb. 1978; U.S. Pat. Des. 341,632 issued to Ganzenhuber on 23 Nov. 1993; U.S. Pat. Des. 343,572 issued to Billelo on 25 Jan. 1994, and U.S. Pat. Des. 269,947 issued to Hartung on 29 Aug. 1983.

While these devices fulfill their respective, particular objectives and requirements, the aforementioned patents do not disclose a new Sip and Spray Fluid Container Assembly. The inventive device includes a fluid container having a handle, a mist spray nozzle with a pump and a pump trigger, a drinking spout, and a fill spout.

In these respects, the Sip and Spray Fluid Container Assembly according to present invention substantially departs from the conventional concepts and designs of the prior art, and in so doing provides an apparatus primarily developed for the purpose of a fluid container for serving drinking water and for spraying cooling mist on the user.

SUMMARY OF THE INVENTION

In view of the foregoing disadvantages inherent in the known types of Spray Bottles now present in the prior art, the present invention provides a new Sip and Spray Fluid Container Assembly construction wherein the same can be utilized for a fluid container for serving drinking water and for spraying cooling mist on the user.

The general purpose of the present invention, which will be described subsequently in greater detail, is to provide a new Sip and Spray Fluid Container Assembly apparatus and method which has many of the advantages of the Spray Bottles mentioned heretofore and many novel features that result in a new Sip and Spray Fluid Container Assembly which is not anticipated, rendered obvious, suggested, or even implied by any of the prior art Spray Bottles, either alone or in any combination thereof.

To attain this, the present invention generally comprises a fluid container having a a fluid container having a handle, a mist spray nozzle with a pump and a pump trigger, a drinking spout, and a fill spout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sip and Spray Fluid Container Assembly apparatus and method which has many of the advantages of the Spray Bottles mentioned heretofore and many novel features that result in a new Sip and Spray Fluid Container Assembly which is not anticipated, rendered obvious, suggested, or even implied by any of the prior art Spray Bottles, either alone or in any combination thereof.

It is another object of the present invention to provide a new Sip and Spray Fluid Container Assembly which may be easily and efficiently manufactured and marketed.

It is a further object of the present invention to provide a new Sip and Spray Fluid Container Assembly which is of a durable and reliable construction.

An even further object of the present invention is to provide a new Sip and Spray Fluid Container Assembly which is susceptible of a low cost of manufacture with regard to both materials and labor, and which accordingly is then susceptible of low prices of sale to the consuming public, thereby making such Sip and Spray Fluid Container Assembly economically available to the buying public.

Still yet another object of the present invention is to provide a new Sip and Spray Fluid Container Assembly which provides in the apparatuses and methods of the prior art some of the advantages thereof, while simultaneously overcoming some of the disadvantages normally associated therewith.

Yet another object of the present invention is to provide a new Sip and Spray Fluid Container Assembly which includes a fluid container having a handle, a mist spray nozzle with a pump and a pump trigger, a drinking spout, and a fill spout.

Still another object of the present invention is to provide a new Sip and Spray Fluid Container Assembly for a fluid container for spraying cooling mist on the user.

Even still another object of the present invention is to provide a new Sip and Spray Fluid Container Assembly wherein a fluid container for serving drinking water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevation view of a new Sip and Spray Fluid Container Assembly according to the present invention.

FIG. 2 is an enlarged view of a new Sip and Spray Fluid Container Assembly drinking spout.

DESCRIPTION OF THE PREFERRED EMBODIMENT

Figure 3:
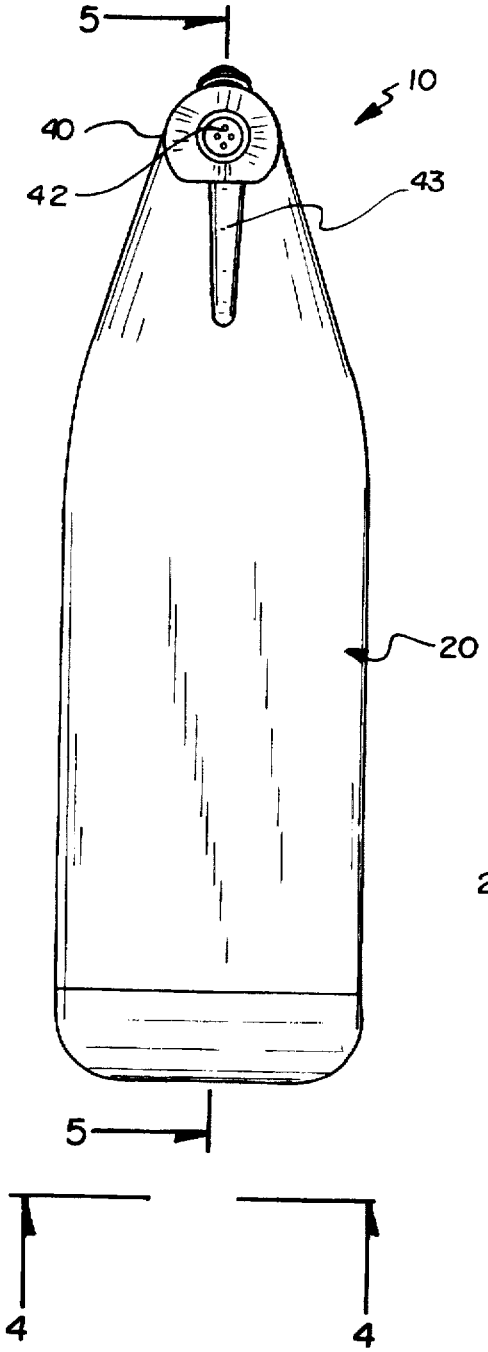
FIG. 3 is an end view of the present invention showing the mist spray head.
Figure 4:
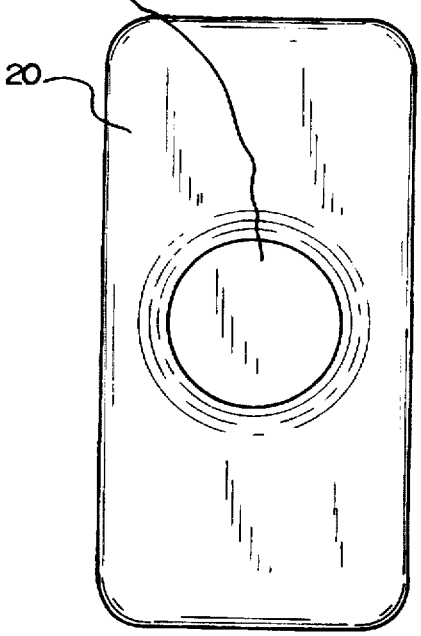
FIG. 4 is a bottom end view of the present invention.

With reference now to the drawings, and in particular to FIGS. 1 through 6 thereof, a new Sip and Spray Fluid Container Assembly embodying the principles and concepts of the present invention and generally designated by the reference numeral 10 will be described.

More specifically, it will be noted that the Sip and Spray Fluid Container Assembly 10; comprises a fluid container 20, having a handle opening 50, a mist spray head 40, a pump and a pump handle 43, a drinking spout 30, and a fill spout 60.

As best illustrated in FIGS. 1 through 6, it can be shown that the Sip and Spray Fluid Container Assembly further comprises a handle opening 50 which includes a drinking handle 51 having a plurality of drinking handle finger grips 53, said drinking handle 51 and drinking handle finger grips 53 are formed into a volumetric part of the fluid container 20. The fluid container 20 also includes a spray bottle handle 52 on a side opposite the drinking handle 51. The spray bottle handle 52 further includes a thumb grip 54 and alternate thumb grips 55. On a side in common with the drinking handle 51, the fluid container 20 further includes a drinking spout 30, said drinking spout 30 is also opposite of said spray bottle handle 52. The drinking spout 30 further includes an open close spout cap 31 which includes a check valve 32 to prevent fluid container 20 contamination. A drinking water outlet 33 transfers water and the like from the fluid container 20 out to the persons'mouth.

Figure 5:
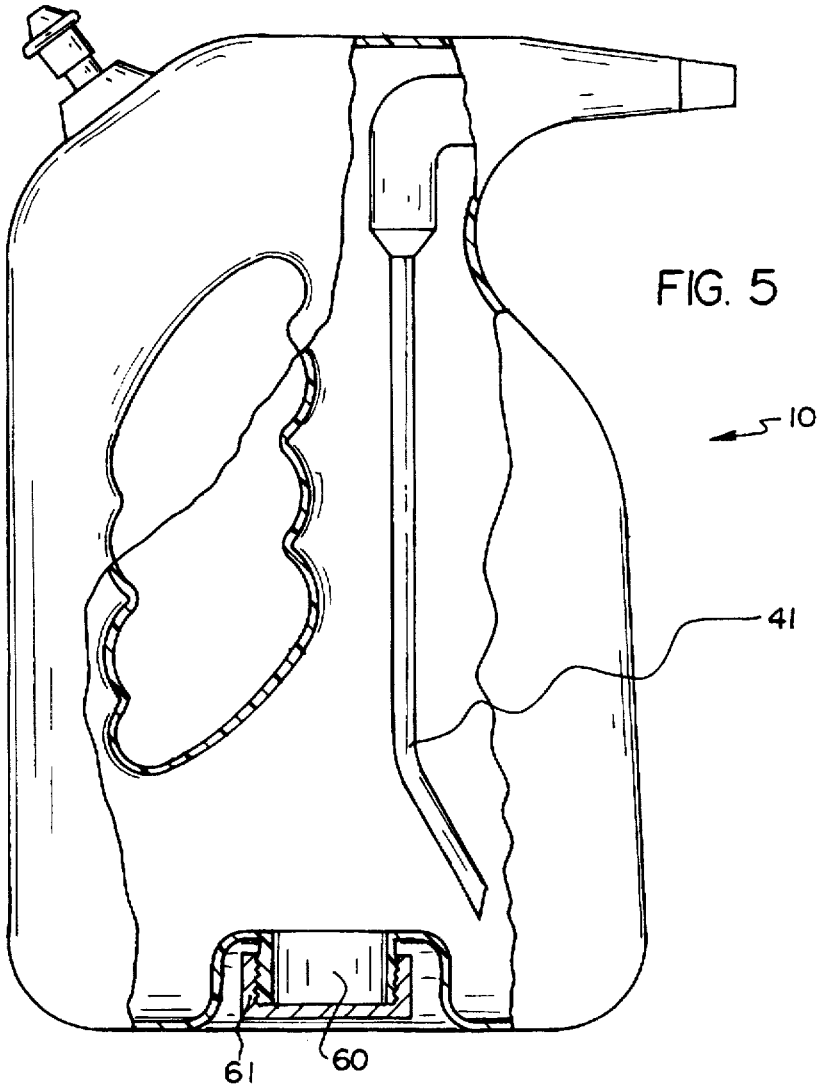
FIG. 5 is a partial cutaway, cross sectional view taken along line 5—5 of FIG. 3.
Figure 6:
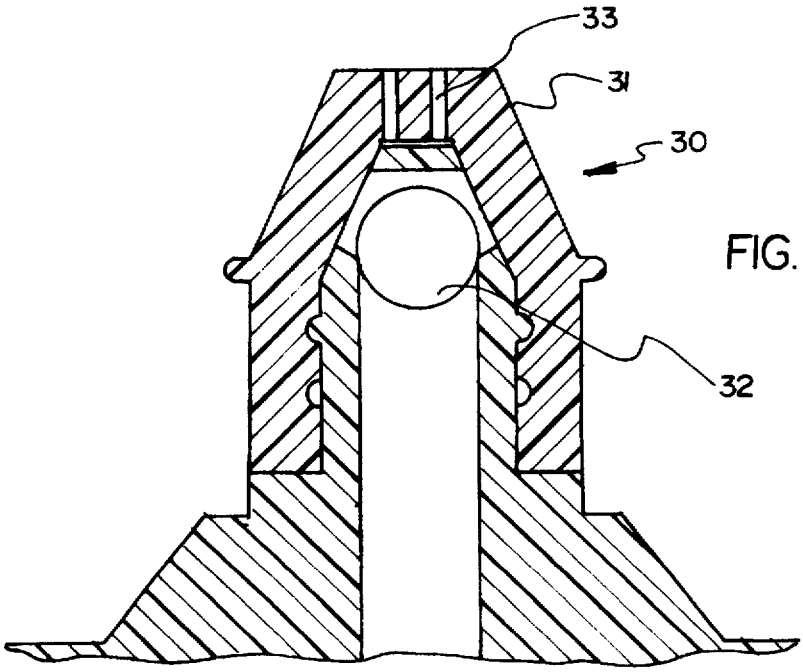
FIG. 6 is a cross sectional view taken along line 6—6 of FIG. 2 of the drinking spout.

Referring to FIGS. 1, 3, and 5, the Sip and Spray Fluid Container Assembly 10 also includes a mist spray head 40 which obtains fluid from the fluid container 20 by way of a draw tube 41. The spray head 40 further comprises a nozzle 42 for the purpose of creating a spray mist of water or the like for the purpose of cooling or a host of other beneficial uses. The nozzle 42 is old and well known as is rotateable nozzles which can be set for spray streams or spray mists, etc. The fluid is forced through the nozzle 42 by a pump and pump handle 43.

Referring to FIGS. 3 and 5, the Sip and Spray Fluid Container Assembly 10 further includes a separate fill spout 60 and a fill cap 61 formed into the bottom of the fluid container 20. The fill spout 60 and fill cap 61 are recess formed into the bottom of the fluid container 20.

In use, the Sip and Spray Fluid Container Assembly is filled with drinking water or any fluid of desire and can be taken any where by the user. In the hot sun light, when children's hard play causes them to feel uncomfortable due to the feeling of over heat, the Sip and Spray Fluid Container Assembly can be used to spray a mist of water on oneself, also a drink can be conveniently taken. The Sip and Spray Fluid Container Assembly can be completely closed off to keep the drinking water clean.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in tile drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Sip and Spray Fluid Container Assembly comprising:

a fluid container having a handle, the fluid container adapted to be carried by a user;

a mist spray head;

a pump and a pump handle for projecting a fluid within the fluid container through the mist spray head; and a drinking spout having an open and close spout cap which controls fluid flow and a check valve for preventing contaminants from entering said fluid in the fluid container, the drinking spout positioned opposite of the mist spray head such that a user can either drink said fluid from the fluid container through the drinking spout without interference from the mist spray head or project the same fluid from the fluid container through the mist spray head.

2. The Sip and Spray Fluid Container Assembly of claim 1, wherein the spout cap has an open position and a closed position, the open position achieved by manipulating the spout cap outwardly from the fluid container, and the closed position achieved by manipulating the spout cap inwardly towards the fluid container.

3. The Sip and Spray Fluid Container Assembly of claim 2, wherein the fluid container is structured to have a broad channel through the fluid container, the channel shaped to form a spray bottle handle proximate the mist spray head.

4. The Sip and Spray Fluid Container Assembly of claim 3, wherein the spray bottle handle container further comprises at least one thumb grip.

5. The Sip and Spray Fluid Container Assembly of claim 3, wherein the fluid container broad channel is structured to form a drinking handle opposite the spray bottle handle.

6. The Sip and Spray Fluid Container Assembly of claim 1, wherein a fill spout is recessed into a bottom of the fluid.

7. The Sip and Spray Fluid Container Assembly of claim 6, wherein the spout cap has an open position and a closed position, the open position achieved by manipulating the spout cap outwardly from the fluid container, and the closed position achieved by manipulating the spout cap inwardly towards the fluid container.

8. The Sip and Spray Fluid Container Assembly of claim 7, wherein the fluid container is structured to have a broad channel through the fluid container, the channel shaped to form a spray bottle handle proximate the mist spray head.

9. The Sip and Spray Fluid Container Assembly of claim 8, wherein the spray bottle handle container further comprises at least one thumb grip.

10. The Sip and Spray Fluid Container Assembly of claim 8, wherein the fluid container broad channel is structured to form a drinking handle opposite the spray bottle handle.

* * * * *